United States Patent [19]

Dean, Jr.

[11] Patent Number: 4,926,595

[45] Date of Patent: May 22, 1990

[54] RETAINING WALL CAP UNIT

[75] Inventor: Robert W. Dean, Jr., Milwaukee, Wis.

[73] Assignee: Stonewall Landscape Systems, Inc., Milwaukee, Wis.

[21] Appl. No.: 345,884

[22] Filed: May 1, 1989

[51] Int. Cl.[5] ..... E04F 19/02

[52] U.S. Cl. ..... 52/300

[58] Field of Search ..... 52/300, 489

[56] References Cited

U.S. PATENT DOCUMENTS

| | | | |
|---|---|---|---|
| D. 295,788 | 5/1988 | Forsberg . | |
| D. 295,790 | 5/1988 | Forsberg . | |
| D. 296,007 | 5/1988 | Forsberg . | |
| D. 296,365 | 6/1988 | Forsberg . | |
| D. 297,464 | 8/1988 | Forsberg . | |
| D. 297,574 | 9/1988 | Forsberg . | |
| D. 297,767 | 9/1988 | Forsberg . | |
| D. 298,463 | 11/1988 | Forsberg . | |
| D. 299,067 | 12/1988 | Forsberg . | |
| D. 300,253 | 3/1989 | Forsberg . | |
| D. 300,254 | 3/1989 | Forsberg . | |
| 2,324,643 | 11/1940 | Phillips | 52/300 |
| 4,083,158 | 4/1978 | Wolma | 52/300 |
| 4,335,549 | 6/1982 | Dean, Jr. . | |
| 4,379,659 | 4/1983 | Steiner . | |
| 4,521,138 | 6/1985 | Steiner . | |
| 4,738,059 | 4/1988 | Dean, Jr. . | |
| 4,802,320 | 2/1989 | Forsberg . | |

OTHER PUBLICATIONS

Allan Block brochure.
Paverlock Sheet.
Loffelstein ® Paver Systems, Inc. brochure.
Versa-Lok ® brochure.
Terrastop brochure.
Keystone Retaining Wall Systems Installation Guidelines brochure.
Keystone Retaining Wall Systems Specifications and Installation Guidelines brochure.
Keystone Retaining Wall Systems Product Profile Sheet.
Keystone Retaining Wall System drawings.

*Primary Examiner*—David A. Scherbel
*Assistant Examiner*—Michel A. Van Patten
*Attorney, Agent, or Firm*—Andrus, Sceales, Starke & Sawall

[57] ABSTRACT

A cap unit for a retaining wall constructed of a plurality of courses of concrete blocks, in which at least the uppermost course of blocks in the retaining wall is provided with a connector member having an upstanding portion extending above the upper surface of the block, is provided with a recess or cavity in its underside for receiving the upstanding portion of the connector member. The cap unit is constructed such that the upstanding portion of the connector member abuts a side of the cavity so as to prevent lateral forward movement of the cap unit relative to the block therebelow. The cavity comprises a slot extending the width of the cap unit to accommodate varying placements of the connector member relative to the cap unit. The cap unit is formed so as to provide first and second end surfaces substantially parallel to each other, with a first side surface extending therebetween. The first side surface is perpendicular to both the first and second end surfaces. A second side surface is spaced from the first side surface, and extends between the first and second end surfaces in a non-parallel relationship relative to the first side surface, so that one of the end surfaces is wider than the other. With this construction, the cap units can be placed atop the retaining wall with the wide and narrow end portions alternately facing outwardly to provide a straight run of cap units. An inside radius of curvature can be provided to the cap unit course by positioning the cap units such that only the narrow end surfaces face outwardly, and an outside radius of curvature can be provided to the cap unit course by placing the cap units such that only the wide end surfaces face outwardly. In order accommodate such alternating placement of the cap units, a slot is provided adjacent each end of the cap units so as to receive the connector member mounted to the block therebelow.

9 Claims, 2 Drawing Sheets

RETAINING WALL CAP UNIT

BACKGROUND AND SUMMARY

This invention relates to a concrete wall unit, and more particularly to a cap unit for a retaining wall.

In a retaining wall constructed of a plurality of courses of concrete blocks, it is known to form the uppermost course in the retaining wall of a series of cap units to cover the hollow cores of the blocks forming the lower retaining wall courses.

A particularly advantageous block structure for constructing a retaining wall is disclosed in my co-pending application Ser. No. 07/304,793 filed Jan. 31, 1989. The retaining wall block therein disclosed includes a rear web having a recess formed in its upper surface, with a clip adapted for placement therewithin. The clip has depending inner and outer legs for engaging the inner and outer surfaces of the rear web, and an upper portion therebetween which is adapted for placement within the recess. An upstanding portion of the clip projects upwardly above the upper surface of the block to which the clip is mounted, for engaging the inner surface of the rear web of a block in the course thereabove.

The present invention provides a cap unit block structure for use on a retaining wall constructed of a plurality of courses of blocks as described. A plurality of cap units according to the invention are adapted for side-by-side placement atop the uppermost course of retaining wall units to form the topmost block course and to cap off the retaining wall so constructed. In accordance with the invention, a retaining wall cap unit comprises a cast concrete block having an upper surface, a lower surface, first and second end surfaces and first and second side surfaces. The upper surface of the cap unit is substantially solid so as to provide a cavity-free cap to the retaining wall. A cavity is formed in the bottom surface of the unit, and is adapted to receive the upstanding portion of the clip mounted to a block in the course therebelow. In a preferred embodiment, the cavity preferably comprises a slot extending throughout substantially the entire width of the cap unit bottom surface between the first and second side surfaces. The cap unit is constructed so that one of the first and second end surfaces is narrower in width than the other of such surfaces. To provide this structure, one of the side surfaces is disposed so as to be substantially perpendicular to both the first and the second end surfaces, while the other of the side surfaces is disposed in a non-parallel relationship to the first-mentioned side surface. With this construction, a straight run is provided by alternately placing the cap units so that one cap unit has its narrow end surface facing outwardly while the adjacent cap unit has its wide end surface facing outwardly. To form an inside radius of curvature, the cap units are placed so that adjacent cap units all have their narrow end surface facing outwardly. Conversely, to form an outside radius of curvature, the cap units are placed so that adjacent cap units all have their wide end surfaces facing outwardly. To accommodate the alternating placement of the cap units to provide a straight run as well as inside and outside curvatures, a pair of cavities as discussed previously are provided on the bottom surface of the cap unit. The cavities are disposed on the bottom surface of the cap unit such that one cavity is located adjacent one of the end surfaces and the other cavity located adjacent the other of the end surfaces. In this manner, no matter which way the cap unit is oriented on the block in the course therebelow, a cavity is provided for receiving the upstanding portion of the clip which is mounted to the lower block.

BRIEF DESCRIPTION OF THE DRAWINGS

The drawings illustrate the best mode presently contemplated of carrying out the invention.

In the drawings.

DETAILED DESCRIPTION OF THE PREFERRED EMBODIMENT

Figure 1:
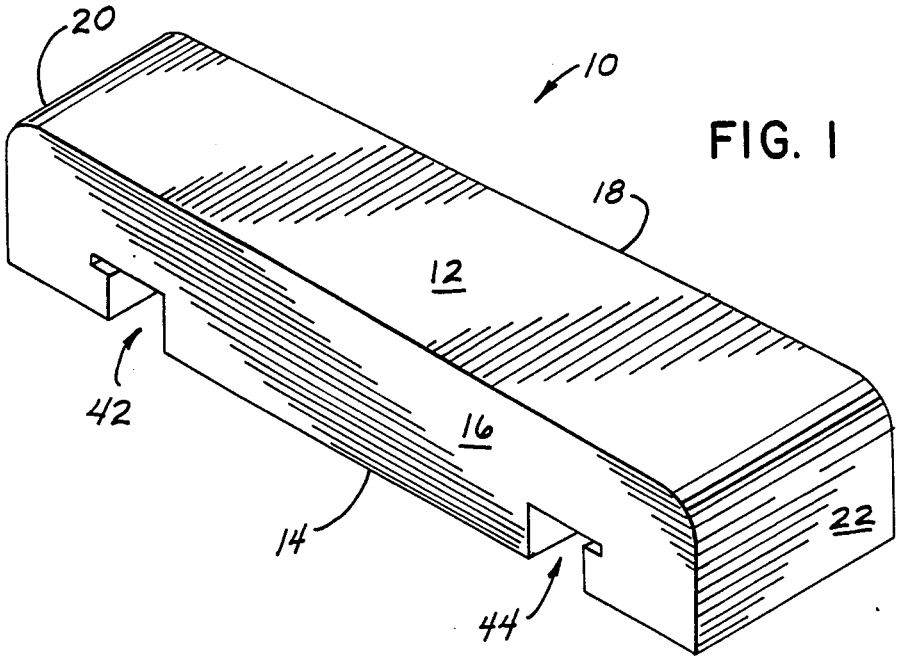
FIG. 1 is an isometric view of a cap unit constructed according to the invention.
Figure 3:
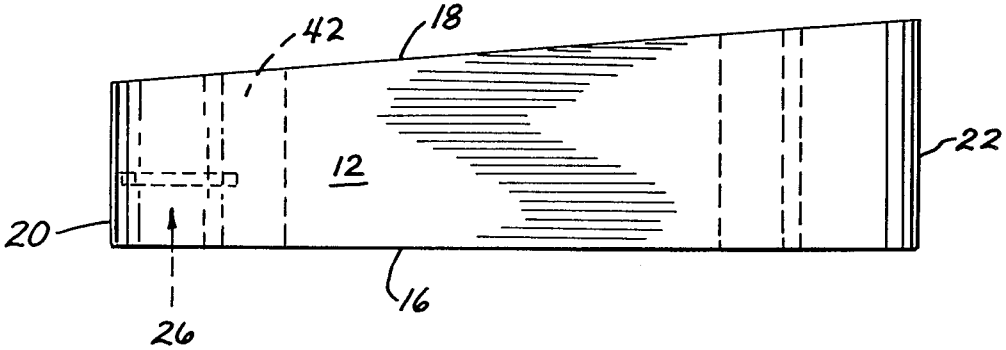
FIG. 3 is a plan view of a cap unit constructed according to the invention.

With reference to FIG. 1, a retaining wall cap unit 10 includes an upper surface 12, a lower surface 14, first and second side surfaces 16, 18, respectively and first and second end surfaces 20, 22, respectively. As can be seen more clearly in FIG. 3, first and second end surfaces 20, 22 are substantially parallel, and end surface 20 has a width less than that of end surface 22. First side surface 16 extends between end surfaces 20, 22 and is substantially perpendicular to end surfaces 20, 22. Second side surface 18 extends between first and second end surfaces 20, 22, and is disposed in a non-parallel relationship to first side surface 16.

Figure 2:
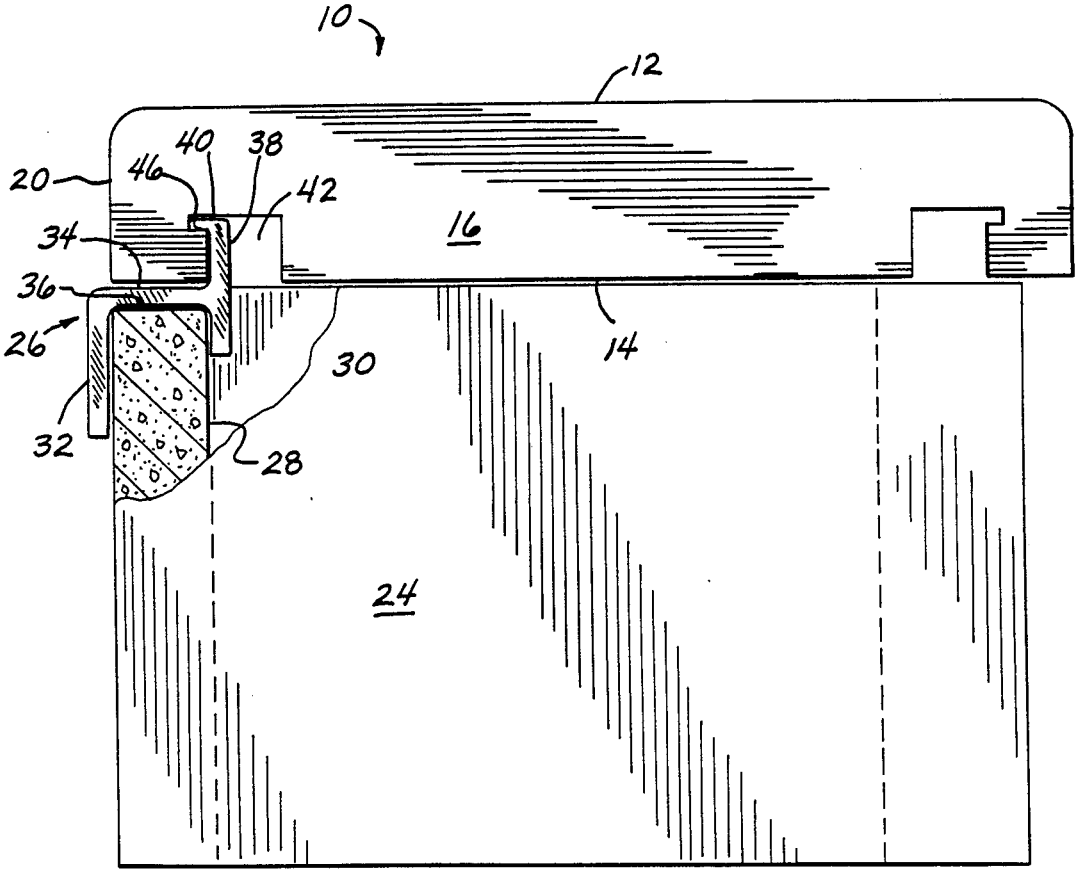
FIG. 2 is a side elevation view, partially in section, showing a cap unit constructed according to the invention as positioned on a block forming a part of a course below the cap unit course, with a portion broken away.

With reference to FIG. 2, cap unit 10 is adapted for placement on the upper surface of the topmost course of retaining wall blocks, one of which is shown at 24. Cap unit 10 is adapted for placement on block 24 such that bottom surface 14 is disposed adjacent the upper surface of block 24, with upper surface 12 facing upwardly Upper surface 12 is substantially solid in construction, providing a cavity-free cap to a retaining wall formed of a plurality of blocks such as 24, which typically have one or more cavities formed therein.

Generally speaking, cap unit 10 is substantially narrower in width than the width of the retaining wall blocks therebelow, such as 24.

With further reference to FIG. 2, retaining wall block 24 has a connector member in the form of a clip, shown generally at 26, mounted to its rear web, shown at 28. Clip 26 includes an inner leg 30 and an outer leg 32, between which an upper portion 34 extends. As explained in my co-pending application Ser. No. 07/304,793, upper portion 34 is disposed within a recess 36 formed in the upper surface of rear web 28. Clip 26 further includes an upstanding portion 38 which projects upwardly from the upper surface of block 24, and which may be provided with a rearwardly extending lip 40.

The underside of cap unit 10 includes a pair of cavities 42, 44, which open onto cap unit bottom surface 14. Cavities 42, 44 are preferably constructed in the form of slots extending between side surfaces 16, 18 and opening thereonto, so as to extend the entire width of cap unit 10. As shown, slot 42 is disposed adjacent cap unit end surface 20, and slot 44 is disposed adjacent end surface 22. Slots 42, 44 extend upwardly within cap unit 10 less than the full height thereof.

Referring still to FIG. 2, slot 42 is adapted to receive upstanding portion 38 of clip 26 mounted to block 24. Slot 42 includes a recess 46 which is adapted to receive lip 40 of clip upstanding portion 38. After lower block 24 is installed and clip 26 mounted thereto, cap unit 10 is simply positioned thereover so that clip upstanding portion 38 is received within slot 42, whereafter cap unit 10 is moved forwardly (rightwardly, with reference to FIG. 2), so that lip 40 is received within recess 46 and upstanding portion 38 engages the rear wall of slot 42. In this manner, upstanding portion 38 prevents lateral forward movement of cap unit 10, and lip 40 prevents inadvertent uplifting of cap unit 10.

As shown, cap unit 10 has a depth greater than that of block 24 so that second end surface 22 overhangs the front surface of block 24. In this manner, entry of moisture into the cavities of block 24 is prevented.

Figure 4:
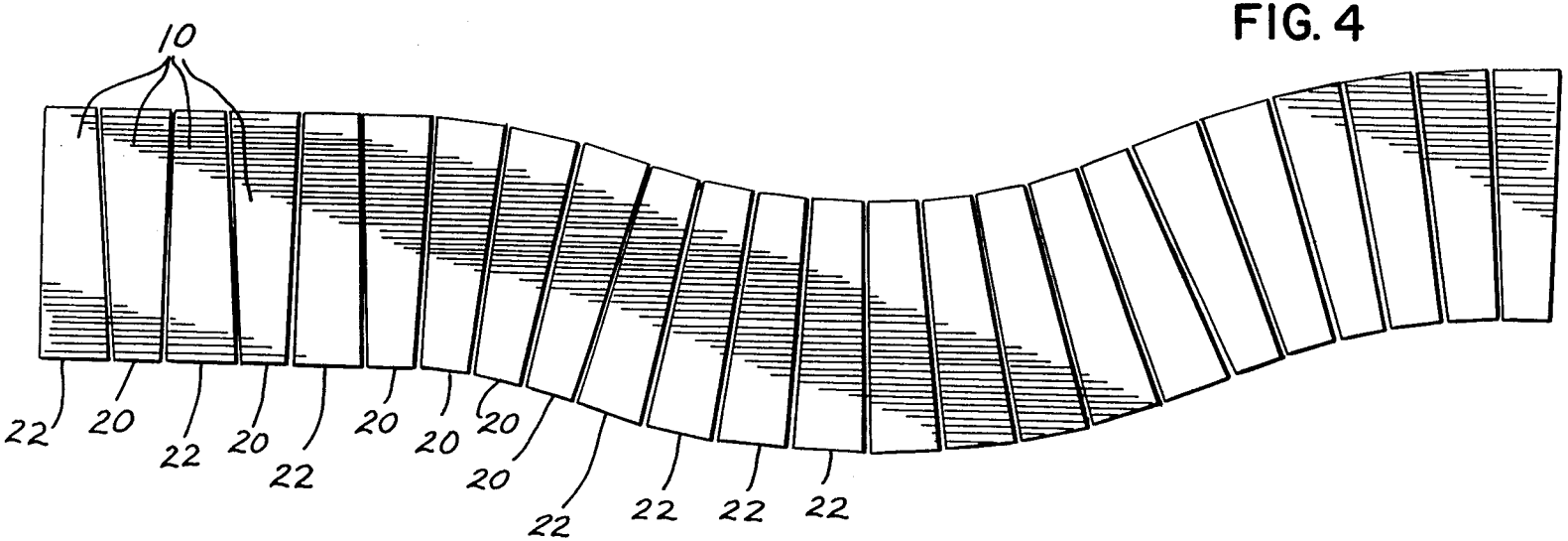
FIG. 4 is a plan view of a plurality of cap units of the invention forming a straight wall portion, an inside radius of curvature and an outside radius of curvature.

Referring now to FIG. 4, a plurality of cap units 10 are illustrated forming the uppermost course in a retaining wall. To form a straight section, shown at the leftward end of FIG. 4, cap units 10 are positioned such that first and second end surfaces 20, 22 alternately face outwardly. To form an inside radius of curvature, cap units 10 are positioned such that only first end surfaces 20 face outwardly. The narrower dimension of first end surface 20 relative to second end surface 22, with placement of side surfaces 16, 18 adjacent each other, provides the inside radius of curvature. Conversely, to provide an outside radius of curvature, cap units 10 are positioned so that only second end surfaces 22 face outwardly. The cap unit course can thus be constructed so as to conform to the shape of the wall provided by the lower retaining wall blocks.

In order to accommodate the alternate placement of cap units 10 as described with reference to FIG. 4, one or the other of slots 42, 44 receives the upstanding portion, such as 38, of the clip mounted to the block, such as 24, in the course therebelow. Clips 26 are selectively placed within the block cavities so that each cap unit receives the upstanding portion of a clip to retain the cap unit on the wall.

Various alternatives and modifications are contemplated as being within the scope of the following claims particularly pointing out and distinctly claiming the subject matter regarded as the invention.

I claim:

1. A cap unit for a retaining wall, said retaining wall being constructed of a plurality of retaining wall blocks in which at least the uppermost course of retaining wall blocks is provided with a plurality of connector members, each connector member having an upstanding portion extending above the upper surface of the blocks in said uppermost course, said cap unit comprising:

first and second end surfaces;

first and second side surfaces extending between said first and second end surfaces;

a top surface; and a bottom surface;

said cap unit being adapted for placement on said uppermost course of retaining wall blocks such that either its first end surface or its second end surface faces outwardly; and said bottom surface being provided with a pair of cavities, with one of said cavities being disposed toward said first end surface and the other of said cavities being disposed toward said second end surface, said cavities being arranged such that one of said cavities receives the upstanding portion of said connector member when said cap unit is positioned such that said first end surface faces outwardly, and the other of said cavities receives the upstanding portion of said connector member when said cap unit is positioned such that said second end surface faces outwardly.

2. The cap unit of claim 1, wherein said pair of cavities are arranged such that, when said cap unit is placed on the uppermost course of said retaining wall blocks, the upstanding portion of said connector member engages a wall of one of said cavities for preventing lateral forward movement of said cap unit.

3. The cap unit of claim 2, wherein the upstanding portion of said connector member includes a laterally extending lip, and wherein said pair of cavities each include a recess for receiving said lip when said cap unit is positioned on the uppermost course of said retaining wall blocks, for preventing uplifting of said cap unit.

4. The cap unit of claim 2, wherein said cavities comprise a pair of slots extending the width of said cap unit between said first and second side surfaces for allowing variable placement of the upstanding portion of said connector member therewithin.

5. A cap unit for a retaining wall, said retaining wall being constructed of a plurality of retaining wall blocks in which at least the uppermost course of retaining wall blocks is provided with a plurality of connector members, each connector member having an upstanding portion extending above the upper surface of the blocks in said uppermost course, said cap unit comprising:

first and second end surfaces;

first and second side surfaces extending between said first and second end surfaces;

a top surface; and a bottom surface;

said first and second side surfaces being non-parallel so that one of said end surfaces is wider than the other of said end surfaces;

said cap unit being adapted for placement in a cap unit course wherein a series of cap units are adapted for side-by-side placement, wherein a straight run is provided by alternately placing said cap units so that the side surfaces of adjacent cap units are disposed closely adjacent each other and said first and second end surfaces alternately face outwardly, and a curved run is provided by placing said cap units such that either the first end surfaces or the second end surfaces of adjacent blocks face outwardly; and the bottom surface of each said cap unit including means for receiving the upstanding portion of said connector member and accommodating alternating placement of said cap units on the uppermost course of said retaining wall blocks.

6. The cap unit of claim 5, wherein said first and second end surfaces are substantially parallel, and wherein one of said first or second side surfaces is disposed substantially perpendicular to said end surface; and the other of said side surfaces is non-parallel relative to said first-mentioned of said side surfaces.

7. The cap unit of claim 5, wherein said connector member is placed at a predetermined front-to-rear position on each retaining wall block forming the uppermost course thereof, and wherein said receiving means comprises a pair of cavities formed in the bottom surface of said cap unit, with one of said cavities receiving the upstanding portion of said connector member when said cap unit is placed on the uppermost course of said retaining wall blocks.

8. The cap unit of claim 7, wherein said pair of cavities comprises a pair of transversely extending slots formed in said bottom surface.

9. The cap unit of claim 8, wherein said pair of slots extend throughout the width of said cap unit between said first and second side surfaces.

* * * * *